US007947153B2

(12) United States Patent
Tsai

(10) Patent No.: US 7,947,153 B2
(45) **Date of Patent: *May 24, 2011**

(54) TISSUE PAPER WINDING AND CUTTING APPARATUS

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 902 days.

This patent is subject to a terminal disclaimer.

(21) Appl. No.: 11/882,635

(22) Filed: Aug. 3, 2007

(65) Prior Publication Data

US 2008/0271869 A1 Nov. 6, 2008

(30) Foreign Application Priority Data

May 4, 2007 (TW) ..... 96116023 A

(51) Int. Cl.
*B31C 11/00* (2006.01)

(52) U.S. Cl. ..... 162/283; 242/521

(58) Field of Classification Search ..... 162/283; 242/521, 532.3, 533.1, 534, 542
See application file for complete search history.

(56) References Cited

U.S. PATENT DOCUMENTS 5,137,225 A * 8/1992 Biagiotti ..... 242/521
5,653,401 A * 8/1997 Biagiotti ..... 242/532.3
5,690,296 A * 11/1997 Biagiotti ..... 242/521
5,853,140 A * 12/1998 Biagiotti ..... 242/534
6,422,501 B1 * 7/2002 Hertel et al. ..... 242/532.3
6,752,344 B1 * 6/2004 Biagiotti ..... 242/521
6,877,689 B2 * 4/2005 Butterworth ..... 242/542.1
6,945,491 B2 * 9/2005 Gambini ..... 242/521
7,172,151 B2 * 2/2007 Biagiotti et al. ..... 242/521
7,222,813 B2 * 5/2007 Tsai ..... 242/521
7,469,856 B1 * 12/2008 Tsai ..... 242/532.3
2004/0061021 A1 * 4/2004 Butterworth ..... 242/521
2005/0279875 A1 * 12/2005 Biagiotti et al. ..... 242/533
2009/0026299 A1 * 1/2009 Tsai ..... 242/160.4

* cited by examiner

*Primary Examiner* — Mark Halpern

(74) *Attorney, Agent, or Firm* — Rosenberg, Klein & Lee

(57) ABSTRACT

A tissue paper winding and cutting apparatus includes a first winding roll, at least one core support plate, a pinch roller, and at least one arm. A channel is formed between the core support plate and the first winding roll. A tissue paper is attached to a lower half of the first winding roll for winding around a first core. The pinch roller is arranged below the first winding roll to partially project into the channel, and the arm is extended to a lower side of the first winding roll and has a bottom protuberance facing the pinch roller, so that a narrowed passage is formed in the channel. A second core rolling to and hindered by the narrowed passage holds the tissue paper thereto, and the tissue paper is pulled broken by a pulling force from a rolled tissue formed on the first core.

9 Claims, 15 Drawing Sheets

TISSUE PAPER WINDING AND CUTTING APPARATUS

FIELD OF THE INVENTION

The present invention relates to a winding apparatus, and more particularly, to a tissue paper winding and cutting apparatus.

BACKGROUND OF THE INVENTION

In a conventional tissue paper winding mechanism, a core is generally sent by a conveyor to an upper winding roll and pushed by a push plate into a curved guiding passage to a winding nip, at where a tissue paper is wound around the core to form a paper log, such as a rolled toilet tissue. When the paper log is formed, the tissue paper is either torn by a rotation speed difference of a push lever or cut by a cutter.

U.S. Pat. No. 6,877,689 discloses a rewinder apparatus and method. The rewinder apparatus disclosed in U.S. Pat. No. 6,877,689 has a first winding roll that conveys and supports a web, a curved core support plate for receiving and guiding cores adjacent the first winding roll, and a web separator adjacent the first winding roll. The web is wound in a winding zone located between the first winding roll, a second winding roll, and a rider roll of the rewinder apparatus. The web separator includes a plurality of rotary fingers. Since the web separator is in contact with the web at a rotating velocity at least equal to a moving speed of the web, the web is effectively separated upstream of the web separator, between the core and the web separator.

However, in a tissue paper winding mechanism using the rotating speed difference of a push lever to separate the tissue paper, a control unit is required to control the rotation of the push lever; and in a tissue paper winding mechanism using a cutter to cut the tissue paper, a stroke and timing control device is required to control the actuation of the cutter.

SUMMARY OF THE INVENTION

A primary object of the present invention is to provide a tissue paper winding and cutting apparatus comprising a plurality of arms to form a plurality of protuberances on the first winding roll. The protuberances impede the feeding of tissue paper which is torn by pulling. No cutter or stroke and timing control device is required. This design overcomes the problems in the prior art.

To fulfill the above object, the present invention provides a tissue paper winding and cutting apparatus. The apparatus comprises a first winding roller, at least one core support plate, a pinch roller, and at least one arm. A channel is formed between the core support plate and the first winding roller. A tissue paper is attached to a lower half of the first winding roller for winding around a first core. The pinch roller is arranged below the first winding roll to partially project into the channel, and the arm is extended to a lower side of the first winding roll and has a bottom protuberance facing the pinch roller, so that a narrowed passage is formed in the channel. A second core rolling to and hindered by the narrowed passage holds the tissue paper thereto, and the tissue paper is pulled broken by a pulling force from a rolled tissue formed on the first core.

In the tissue paper winding and cutting apparatus of the present invention, the tissue paper can be pulled broken simply by hindering the rotation of the feeding core by the protuberances at the arms while the pinch roller keeps rotation continuously, without the need of an additional control unit for timely controlling the turning of a push lever or the actuation of a cutter.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
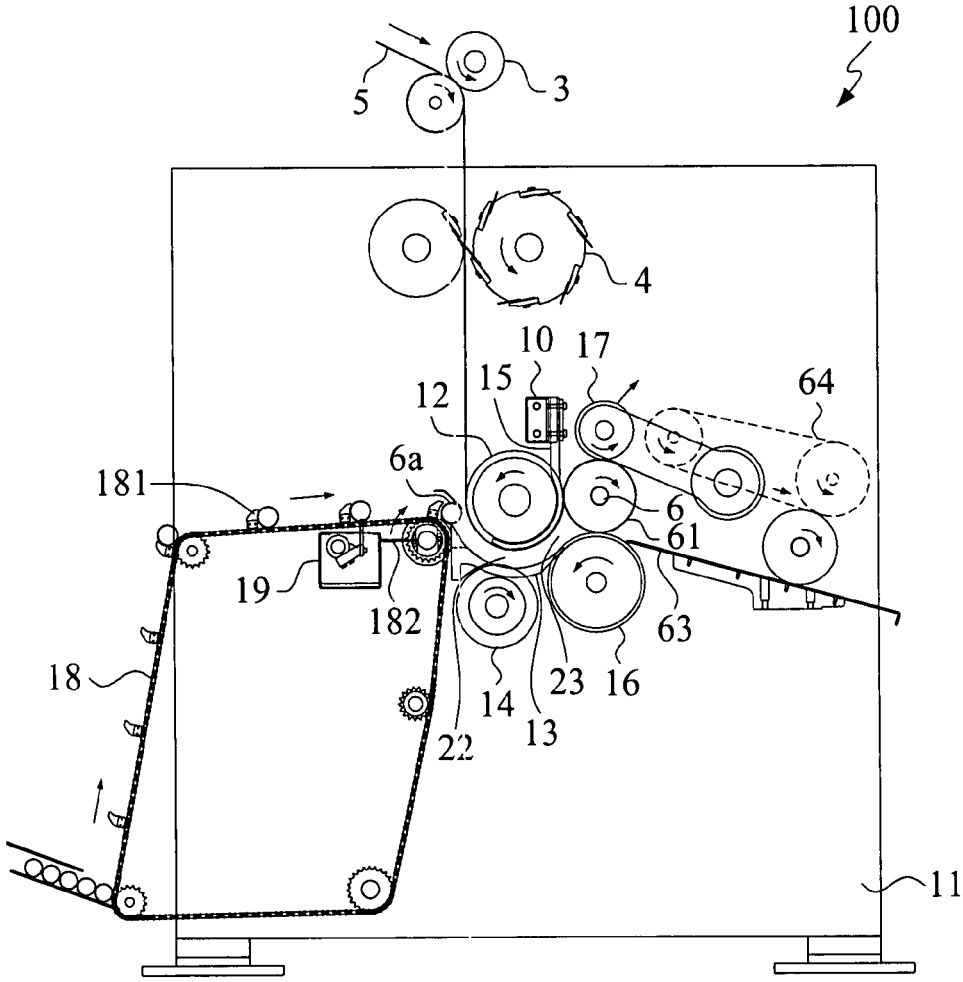
FIG. 1 is a schematic view of a tissue paper winding and cutting apparatus according to a first embodiment of the present invention.
Figure 2:
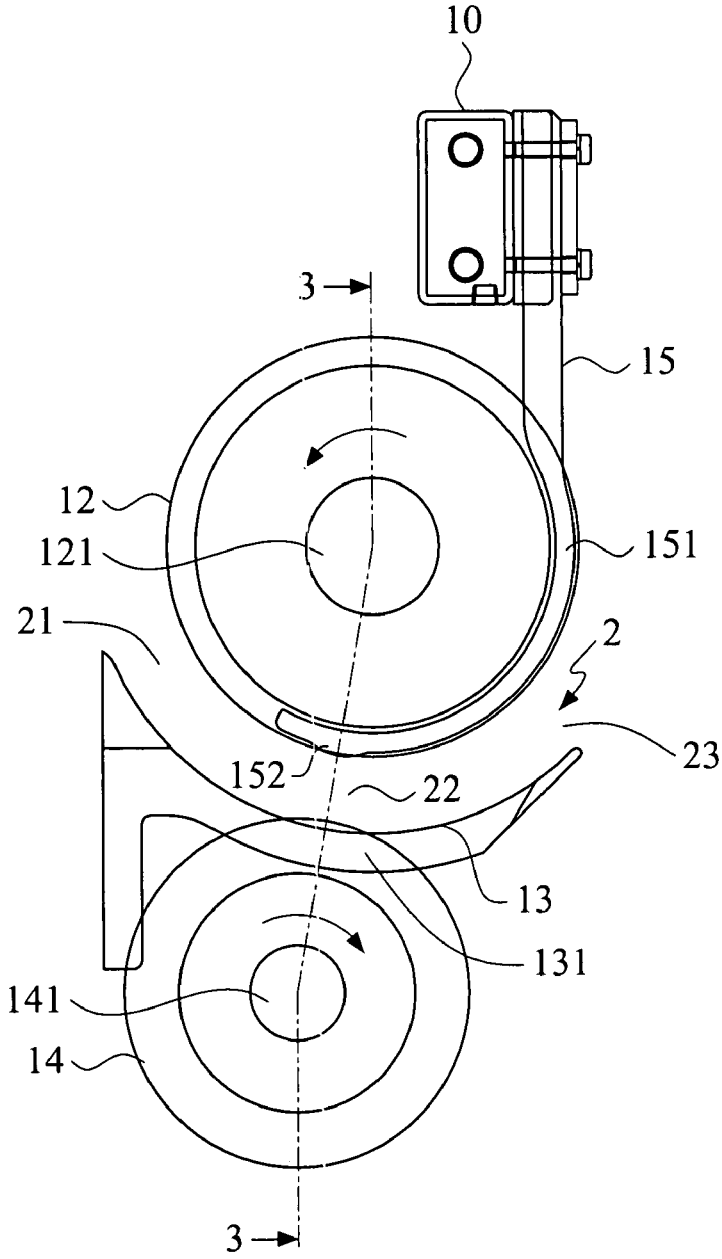
FIG. 2 is an enlarged view of some featured mechanisms of the present invention.
Figure 3:
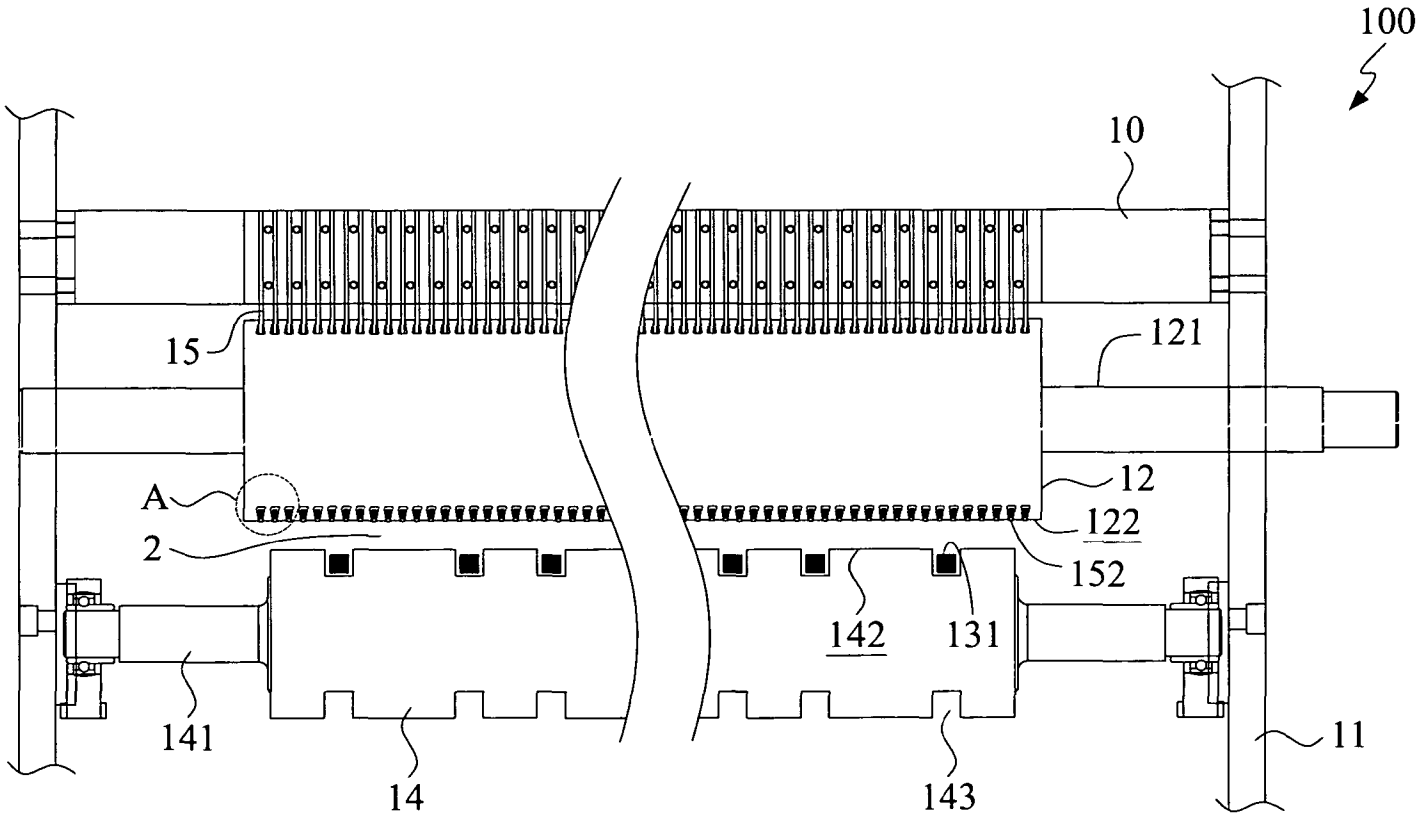
FIG. 3 is a sectional view taken along line 3-3 of FIG. 2.
Figure 4:
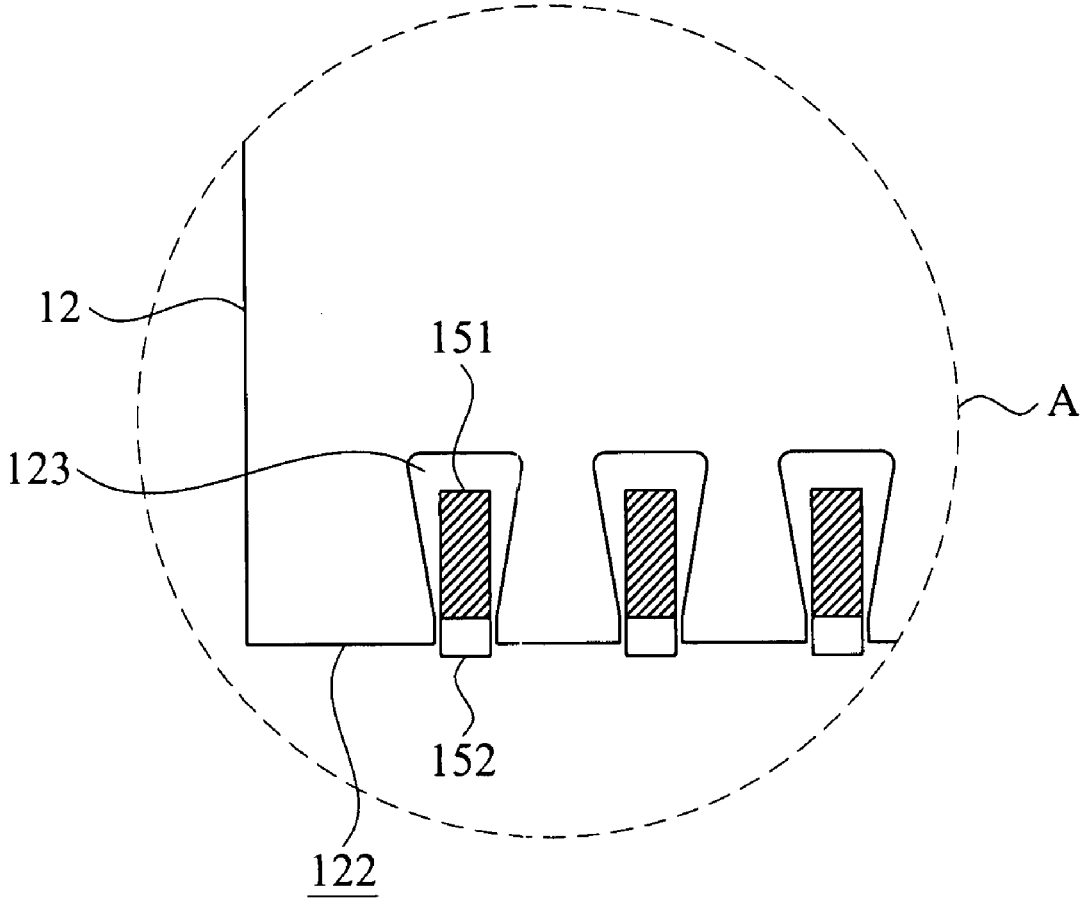
FIG. 4 is an enlarged view of the circled area A in FIG. 3.

Please refer to FIG. 1 that is a schematic view of a tissue paper winding and cutting apparatus 100 according to a first embodiment of the present invention. As shown, the tissue paper winding and cutting apparatus 100 includes a machine frame 11, a first winding roll 12, a plurality of core support plates 13, a pinch roller 14, a plurality of arms 15, a second winding roll 16, a rider roll 17, a conveyer 18, and a gluing unit 19.

Please also refer to FIGS. 2 through 5 at the same time. The first winding roll 12 is mounted on the machine frame 11 via a shaft 121. The plurality of core support plates 13 are arranged below and in the vicinity of the first winding roll 12, so that a channel 2 having a loading nip 21 and a winding nip 23 is formed between the core support plates 13 and the first winding roll 12. In the tissue paper winding and cutting apparatus 100 according to the first embodiment of the present invention, there is further included a pair of puller rollers 3 and a perforation roller 4. A long strip of tissue paper 5 having a predetermined thickness and width is continuously conveyed by the puller rollers 3 to pass through the perforation roller 4 and be perforated. The perforated tissue paper 5 then passes through the loading nip 21 to attach to a lower half circumferential surface of the first winding roll 12 and be wound around a first core 6 at the winding nip 23. The perforation roller 4 is arranged above and in the vicinity of the first winding roll 12 to form a line of perforations across the tissue paper 5 at fixed intervals.

Figure 5:
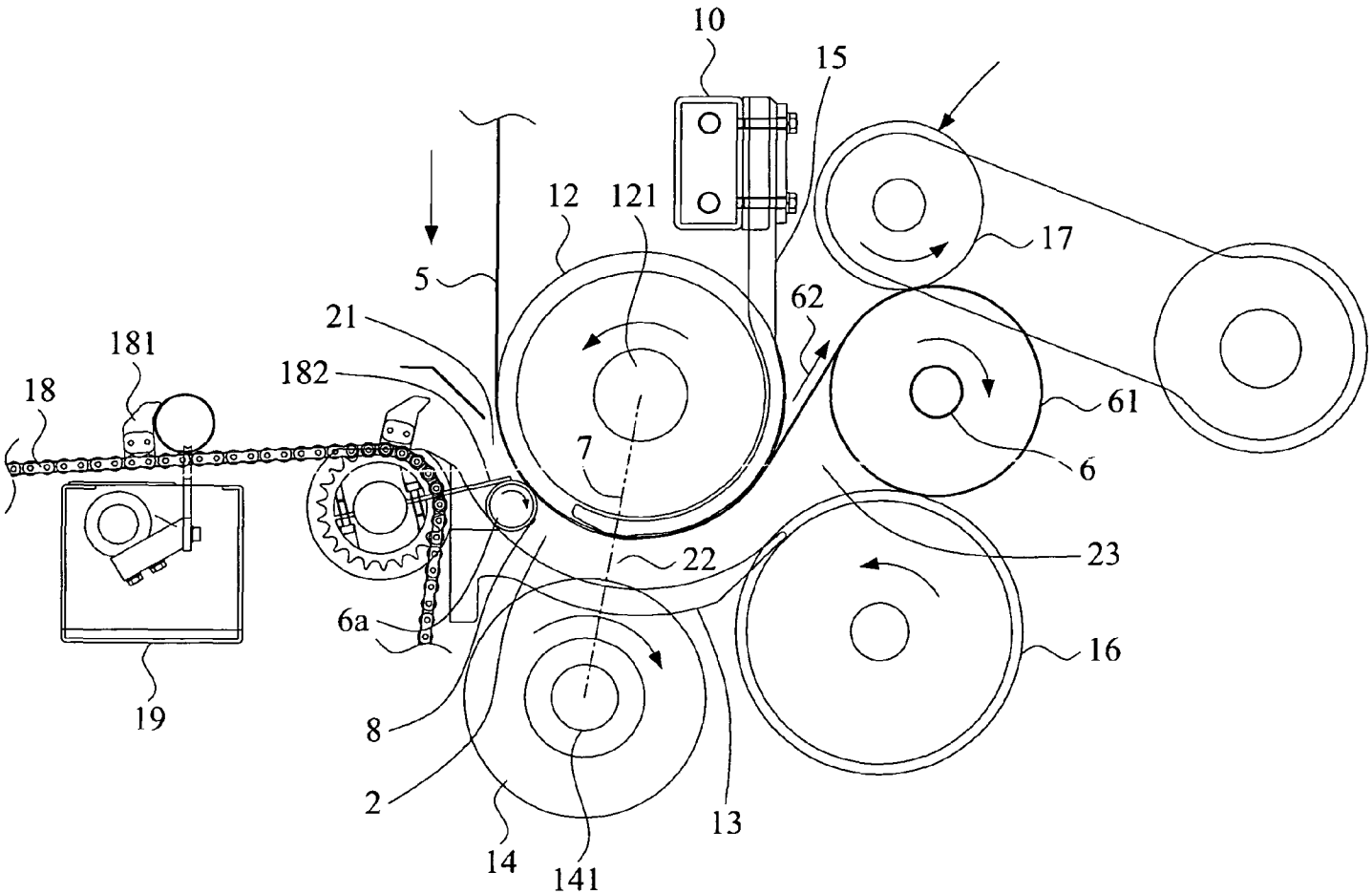
FIG. 5 is a schematic view showing the sending of a core into a channel.

The pinch roller 14 is mounted on the machine frame 11 via a shaft 141, and is arranged below and in the vicinity of the first winding roll 12. An area on a circumferential surface 142 of the pinch roller 14 moving to a lower side of the first winding roll 12 is projected into the channel 2 formed between the core support plates 13 and the first winding roll 12. The pinch roller 14 is formed on the circumferential surface 142 with a plurality of axially spaced annular grooves 143, and the core support plates 13 are received at respective middle part 131 in the annular grooves 143, such that an area of the circumferential surface 142 of the pinch roller 14 intersected with a line segment 7 extended between a center of the shaft 121 and a center of the shaft 141 is higher than the middle parts 131 of the core support plates 13, as can be seen in FIG. 5.

The plurality of arms 15 are fixedly spaced on and along a transverse bar 10. The transverse bar 10 is connected to the machine frame 11 and located above and in the vicinity of the first winding roll 12. Each of the arms 15 includes a circular arc portion 151, which is extended to a lower side of the first winding roll 12. And, a lower outer surface of the circular arc portion 151 on each of the arms 15 facing toward the pinch roller 14 is formed with a protuberance 152, which is projected from a circumferential surface 122 of the first winding roll 12 by a predetermined distance, as can be seen from FIG. 4, such that a narrowed passage 22 is formed in the channel 2 between the protuberances 152 and the exposed circumferential surface 142 of the pinch roller 14. The first winding roll 12 is formed on the circumferential surface 122 with a plurality of axially spaced annular receiving grooves 123, which have a configuration corresponding to that of the circular arc portions 151 for receiving the circular arc portions 151 therein. Moreover, the circular arc portions 151 are received in the annular receiving grooves 123 with only the protuberances 152 protruded from the circumferential surface 122 of the first winding roll 12, and the protuberances 152 are formed at a position on the circular arc portions 151 intersected with the line segment 7.

The second winding roll 16 has a position near and below the first winding roll 12, and higher than the pinch roller 14. A predetermined distance is kept between the second winding roll 16 and the pinch roller 14. The rider roll 17 is arranged near and located above the second winding roll 16. The winding nip 23 is located between the first winding roll 12, the second winding roll 16, and the rider roll 17. The tissue paper 5 is wound around the core 6*a* in the winding nip 23 to thereby form a roll of paper having a predetermined diameter, such as a roll tissue.

The conveyor 18 includes a plurality of carriers 181 and a push plate 182. The gluing unit 19 is arranged at a predetermined position on the conveyor 18. When a plurality of cores are carried by the carriers 181 to sequentially pass through the gluing unit 19, an amount of glue is applied by the gluing unit 19 onto an outer circumferential surface of each of the cores.

Please refer to FIGS. 5 through 10. When a second core 6*a* is carried by one of the carriers 181 of the conveyor 18 to the loading nip 21, the push plate 182 is automatically turned to push the second core 6*a* into the channel 2. At this point, the second core 6*a* is in contact with and brought by the first winding roll 12 to roll forward (i.e. clockwise). It is also noted that the second core 6*a* has passed the gluing unit 19 before being carried to the loading nip 21, and therefore has a length of glue 8 applied thereto.

Figure 6:
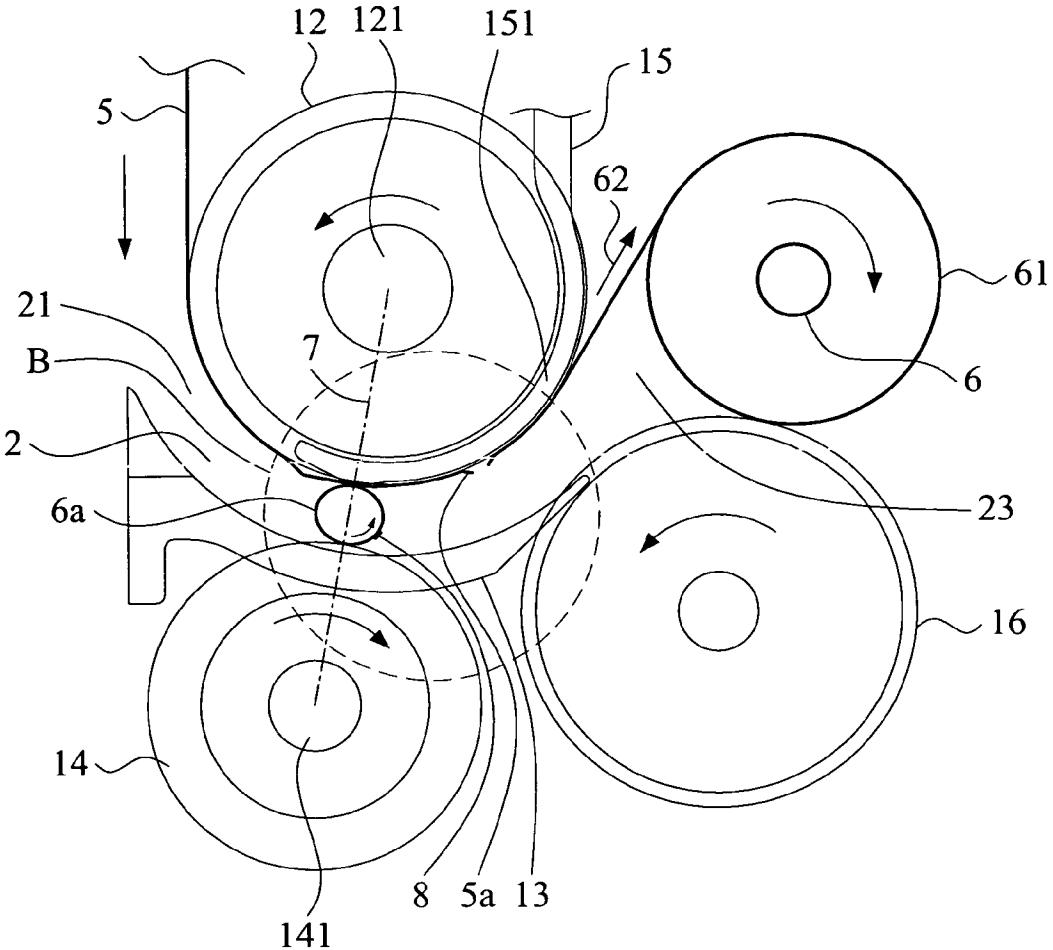
FIG. 6 is a schematic view showing a generation of a pulling force that breaks the tissue paper on the present invention.
Figure 7:
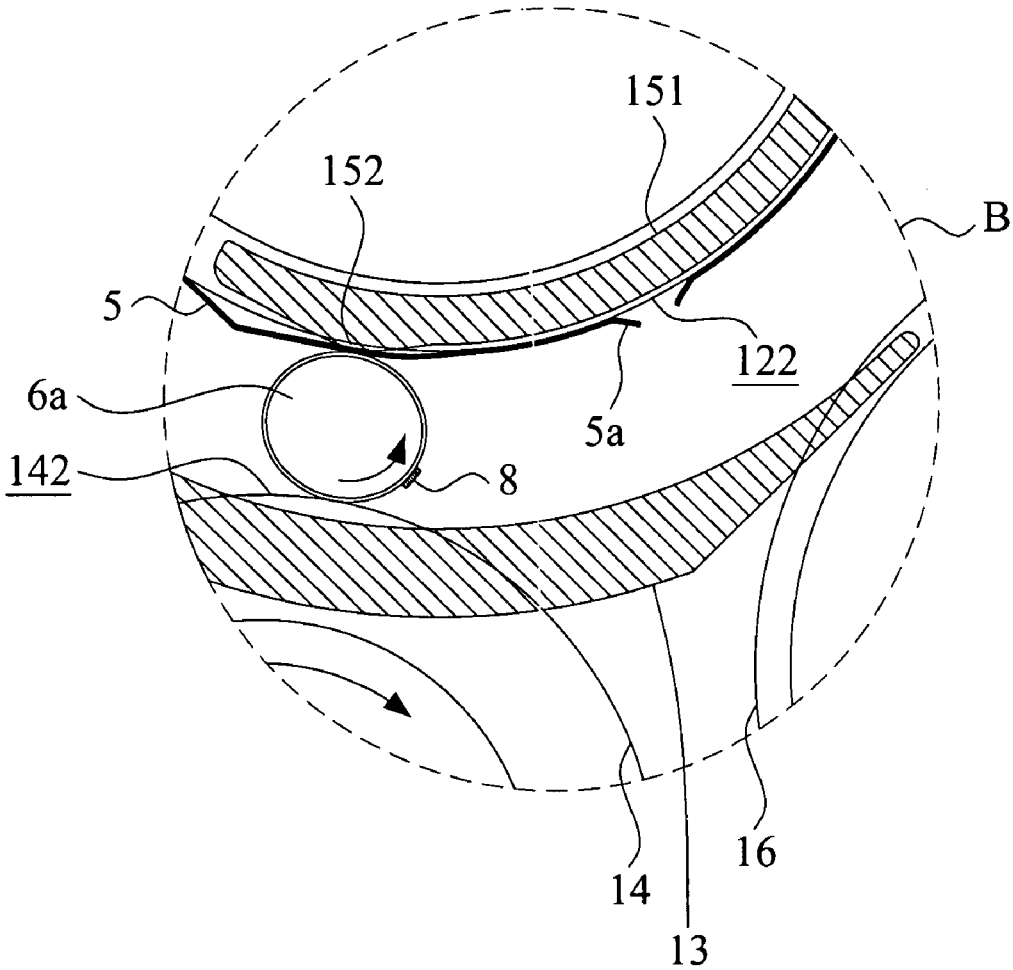
FIG. 7 is an enlarged view of the circled area B in FIG. 6.

When it rolls to the narrowed passage 22, the second core 6*a* is on the one hand hindered by the narrowed passage 22 and on the other hand kept driven by the circumferential surface 142 of the pinch roller 14 to rotate. That is, the second core 6*a* is hindered by the protuberances 152 on the circular arc portions 151 of the arms 15 and the circumferential surface 142 protruded into the channel 2 while being brought by the pinch roller 14 to start rotating counterclockwise, as shown in FIG. 6. At this point, the tissue paper 5 is clamped between the second core 6*a* and the protuberances 152 of the arms 15. However, a rolled tissue 61 formed by the tissue paper 5 wound around the first core 6 is kept rotating to produce a pulling force 62 against the tissue paper 5, pulling and breaking the tissue paper 5 located between the first core 6 and the second core 6*a* to form a new leading edge 5*a* on the long strip of tissue paper 5.

Figure 8:
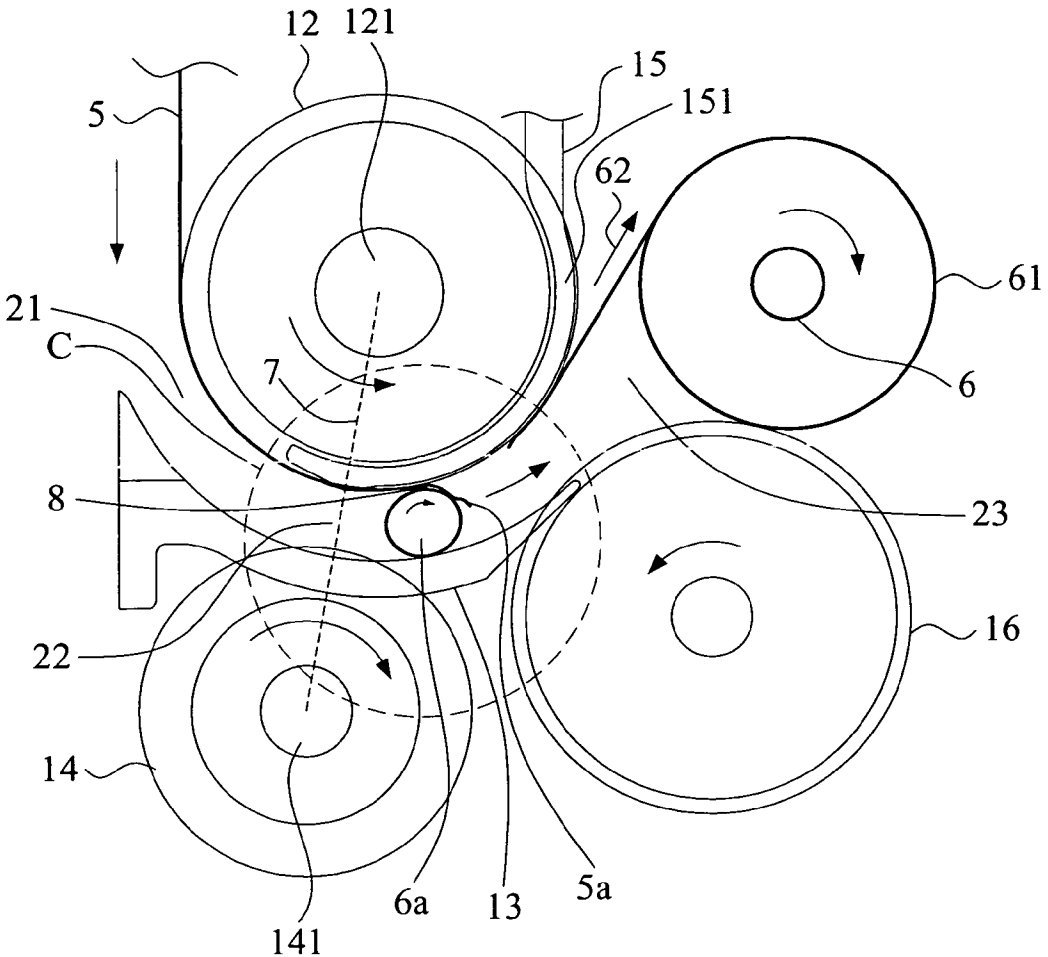
FIG. 8 is a schematic view showing the attachment of the tissue paper to the core.
Figure 9:
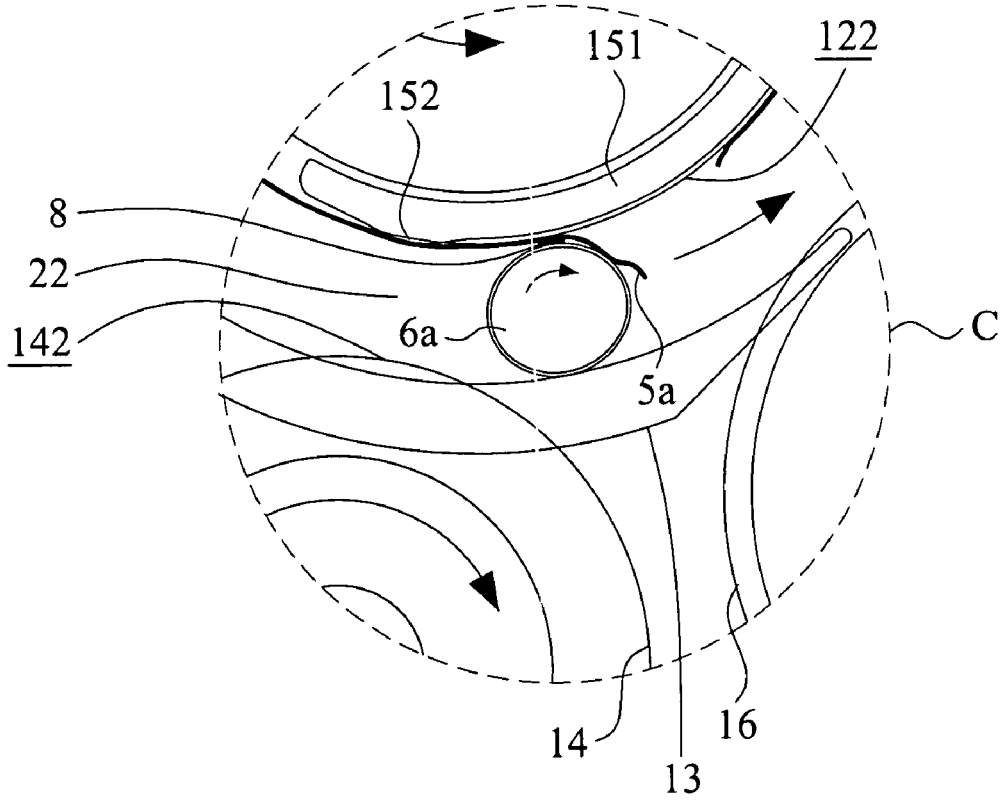
FIG. 9 is an enlarged view of the circled area C in FIG. 8.
Figure 10:
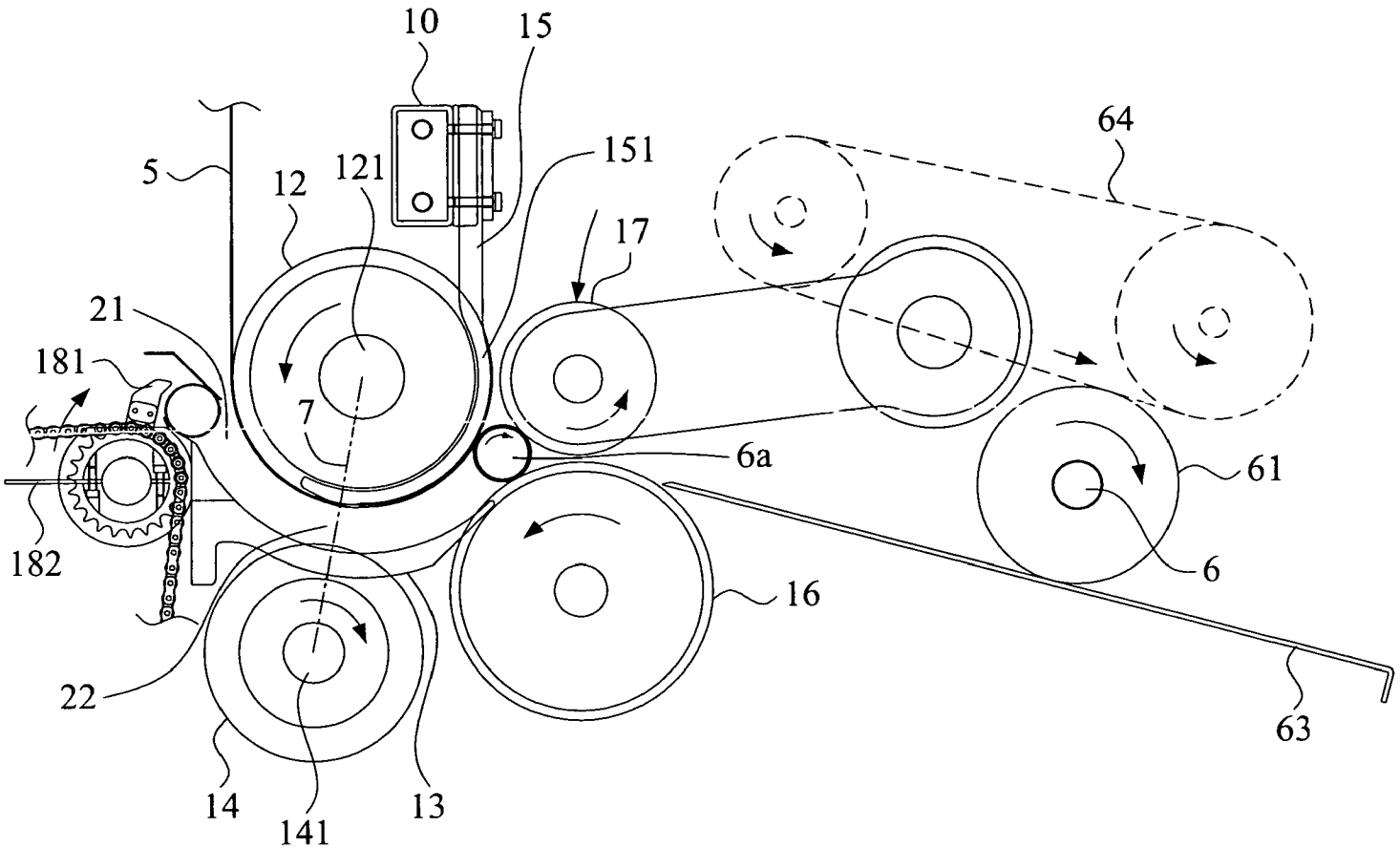
FIG. 10 is a schematic view showing the winding of tissue paper around a first core is completed and the winding of tissue paper around a second core is started.
Figure 11:
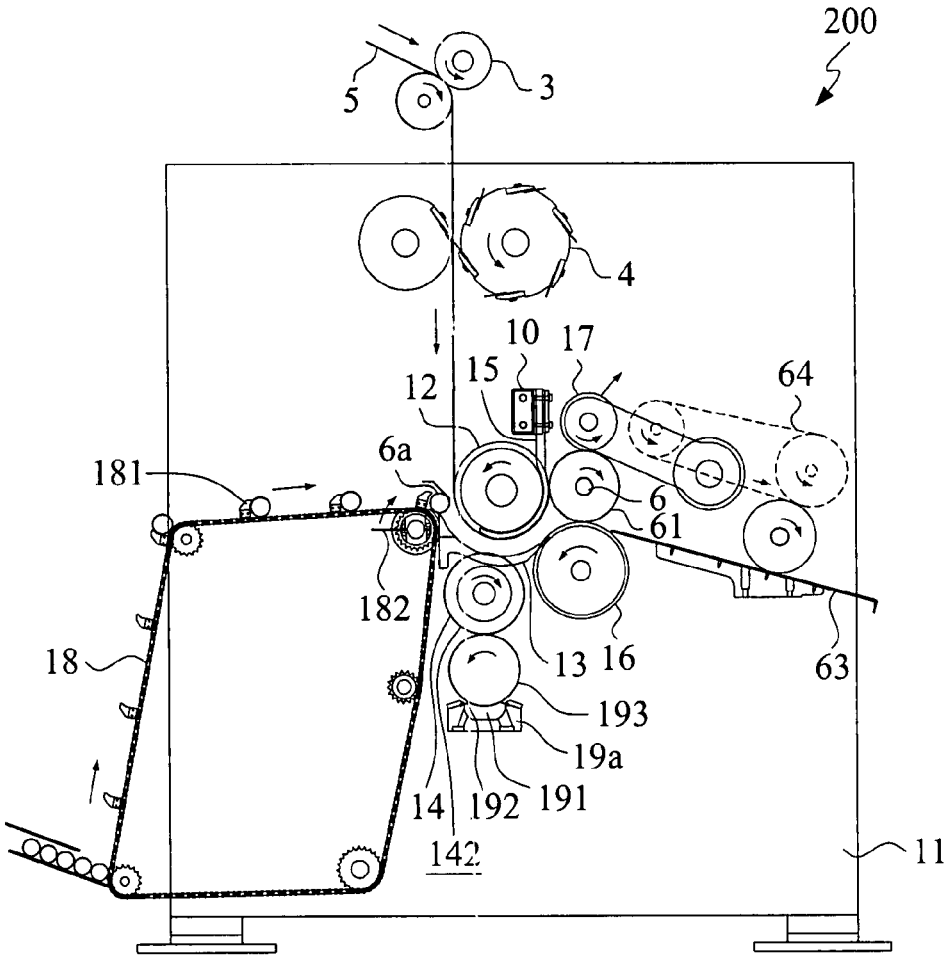
FIG. 11 is a schematic view of a tissue paper winding and cutting apparatus according to a second embodiment of the present invention.

When the second core 6*a* passes through the narrowed passage 22, the second core 6*a* is in contact with and brought by the first winding roll 12 to roll forward (i.e. clockwise) again, as shown in FIG. 8. At this point, the leading edge 5*a* newly formed on the broken strip of tissue paper 5 is quickly adhered to the glue 8 on the outer surface of the second core 6*a*, and the second core 6*a* is transferred to the winding nip 23 due to an effect of speed difference between the first winding roll 12 and the second winding roll 16 caused by a speed reduction of the second winding roll 16, and the winding of the long strip of tissue paper 5 around the second core 6*a* is started. Meanwhile, the completed rolled tissue 61 formed on the first core 6 is moved by a belt 64 to roll down along a chute 63 and be discharged from the apparatus 100, as shown in FIG. 10.

FIGS. 11 through 15 show a tissue paper winding and cutting apparatus 200 according to a second embodiment of the present invention. Since the second embodiment is generally structurally similar to the first embodiment, parts and components that are the same or similar in the two embodiments are denoted by the same reference numerals. The second embodiment is different from the first embodiment in that a glue tank 19*a* containing an amount of glue 191 is provided to replace the gluing unit 19 in the first embodiment. The glue tank 19*a* is arranged below and near the pinch roller 14. Alternatively, the glue tank 19*a* may be located near two lateral sides of the pinch roller 14. A glue dispensing roll 193 is provided between the glue tank 19*a* and the pinch roller 14. When the pinch roller 14 rotates, the glue dispensing roll 193 transfers the glue 191 from the glue tank 19*a* to the circumferential surface 142 of the pinch roller 14, so that a glue layer 191*a* is coated over the circumferential surface 142. The glue tank 19*a* is equipped with at least one pair of scrapers 192 that scrapes off surplus glue from the glue dispensing roll 193 to control the amount of glue to be coated over the circumferential surface 142 of the pinch roller 14.

Figure 12:
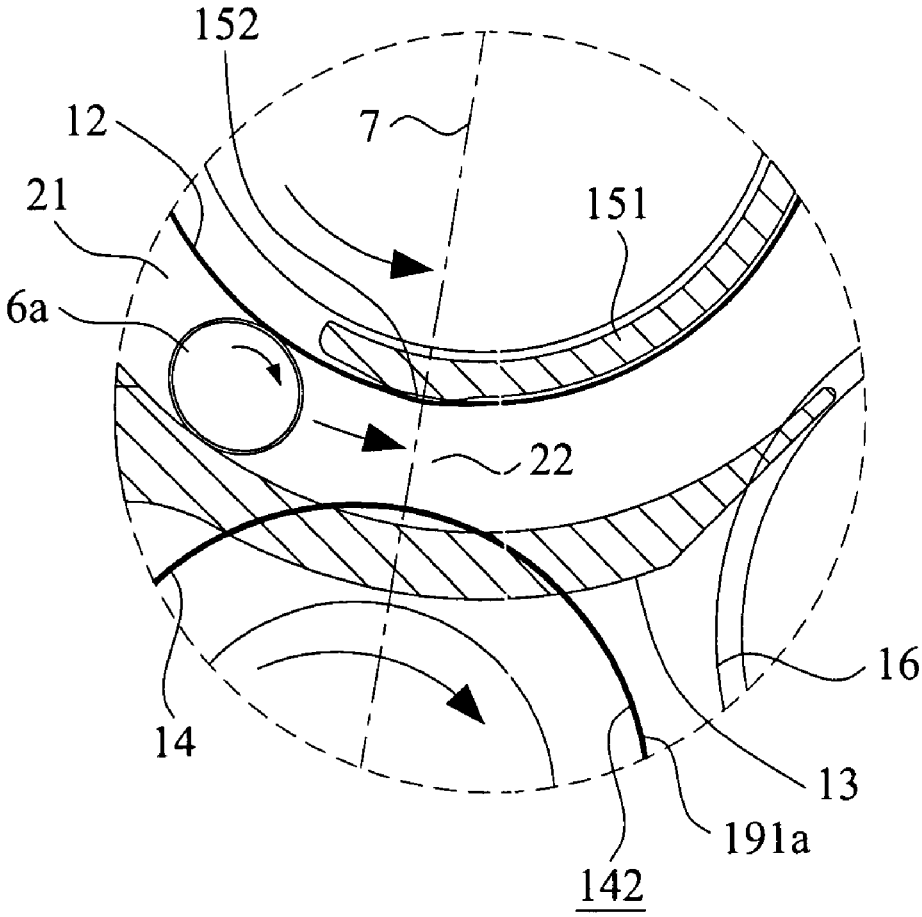
FIG. 12 is an enlarged view showing a pinch roller is applied with glue.
Figure 13:
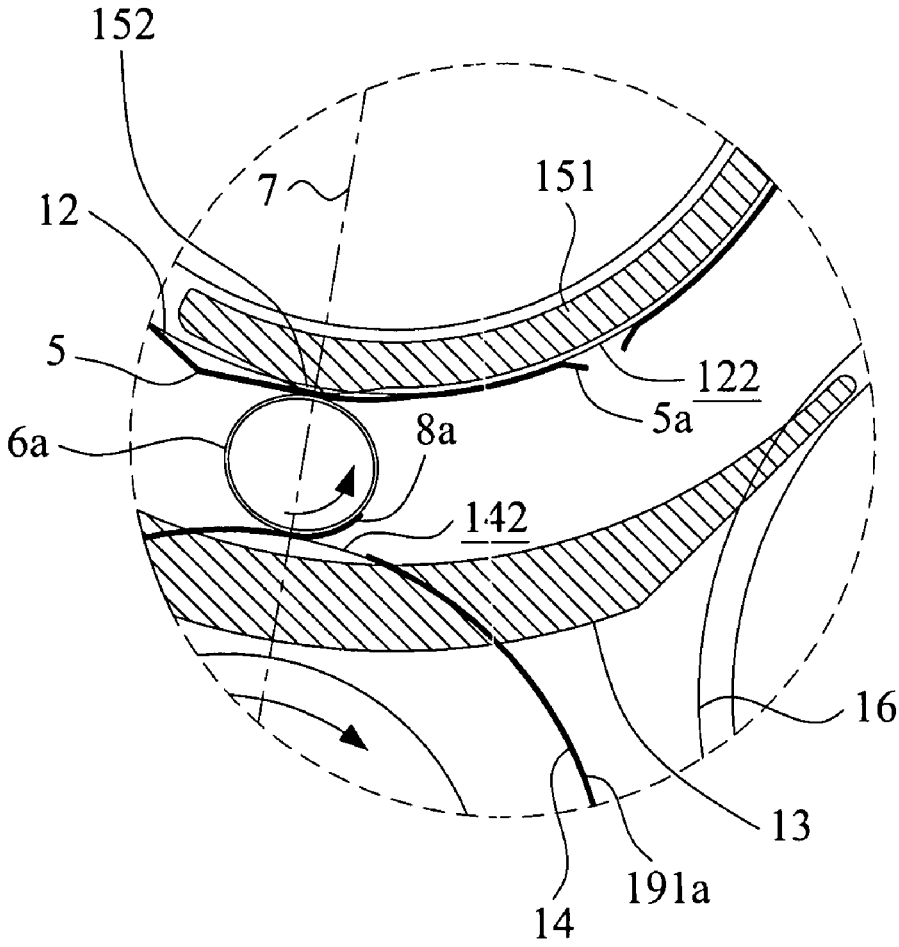
FIG. 13 shows that the core is coated with a glue by the pinch roller.

As can be seen from FIG. 12, at the time the second core 6*a* just passes the loading nip 21 to locate before the narrowed passage 22, the pinch roller 14 has been coated over its circumferential surface 142 with the glue layer 191*a*. And, when the second core 6*a* rolls forward to the narrowed passage 22, the outer surface of the second core 6*a* is in contact with the glue layer 191*a* on the pinch roller 14 to thereby have a length of glue 8*a* attached thereto, as shown in FIG. 13. Just as in the case of the first embodiment, the second core 6*a* in the second embodiment is hindered by the narrowed passage 22 while being driven by the circumferential surface 142 of the pinch roller 14 to roll, and the tissue paper 5 is clamped between the second core 6*a* and the protuberances 152 of the arms 15. However, the rolled tissue 61 is kept rotating to produce a pulling force 62 that finally breaks the tissue paper 5 located between the first core 6 and the second core 6*a* to form a leading edge 5*a* on the long strip of tissue paper 5.

Figure 14:
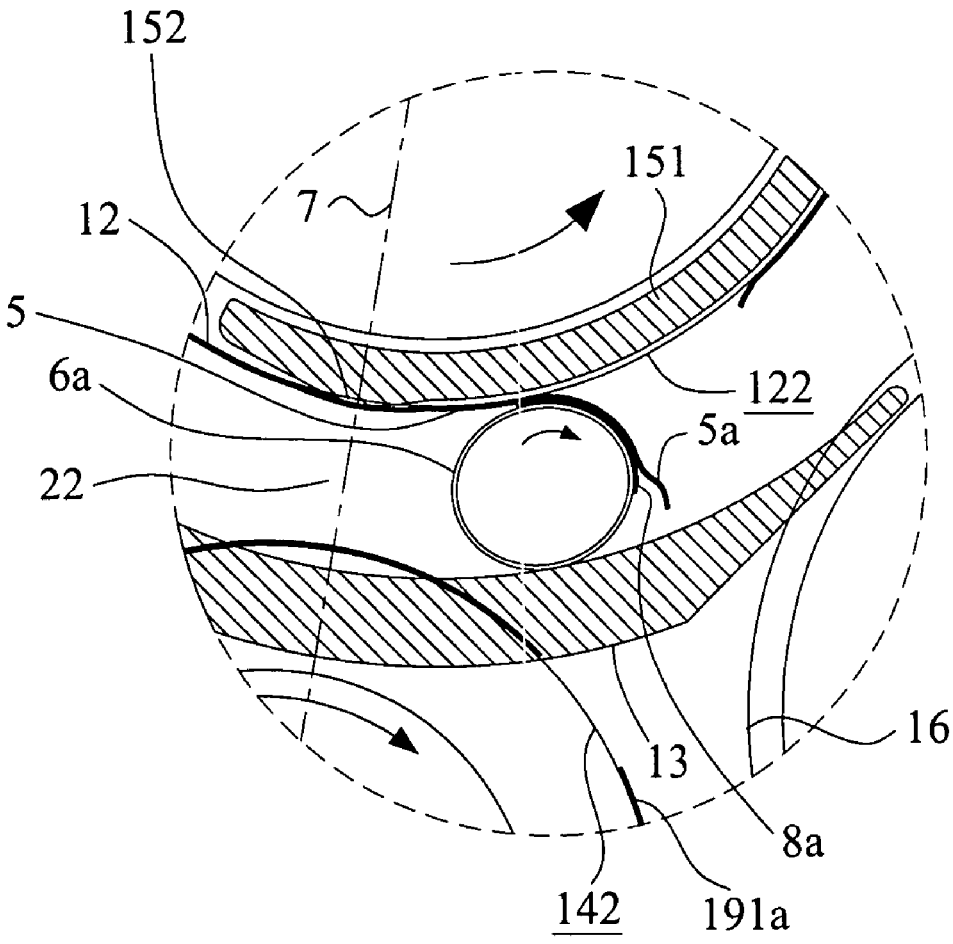
FIG. 14 shows the tissue paper is adhered to the core.
Figure 15:
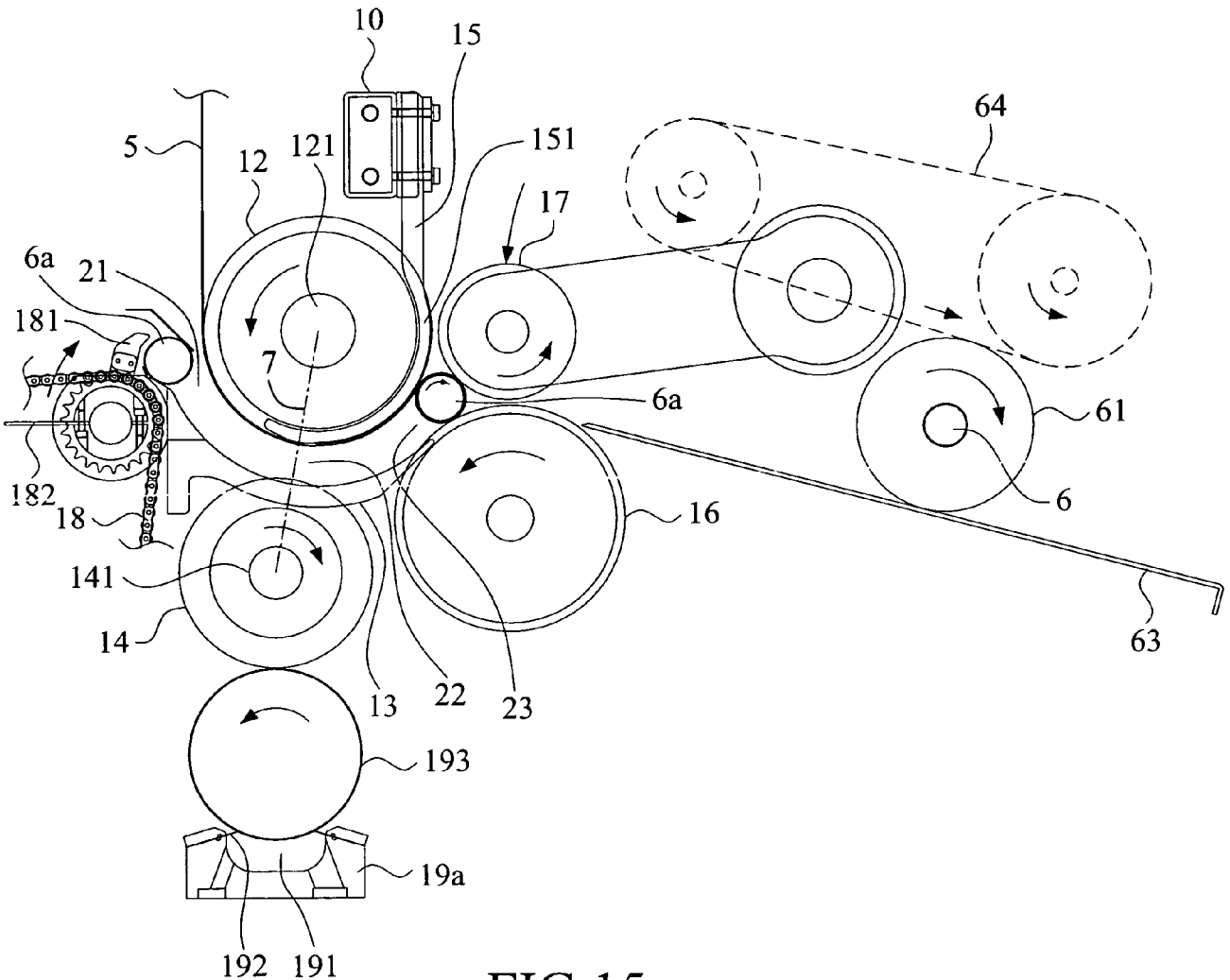
FIG. 15 is a schematic view showing the winding of tissue paper around a first core is completed and the winding of tissue paper around a second core is started on the second embodiment of the present invention.

Please refer to FIG. 14. When it has passed through the narrowed passage 22, the second core 6*a* is in contact with and brought by the first winding roll 12 to roll forward (i.e. clockwise) again. At this point, the leading edge 5*a* newly formed on the broken strip of tissue paper 5 is quickly adhered to the length of glue 8*a* on the outer surface of the second core 6*a*, and the second core 6*a* is transferred to the winding nip 23 due to an effect of speed difference between the first winding roll 12 and the second winding roll 16 caused by a speed reduction of the second winding roll 16, and the winding of the long strip of tissue paper 5 around the second core 6*a* is started. Meanwhile, the completed rolled tissue 61 formed on the first core 6 is moved by the belt 64 to roll down along the chute 63 and be discharged from the apparatus 200, as shown in FIG. 15.

What is claimed is:

1. A tissue paper winding and cutting apparatus, comprising:

a first winding roll;

at least one core support plate arranged in the vicinity of the first winding roll, a channel having a loading nip and a winding nip being formed between the first winding roll and the core support plate, whereby a continuous strip of tissue paper is passed through the loading nip to attach to a lower half circumferential surface of the first winding roll and be wound around a first core in the winding nip;

a pinch roller spaced from the first winding roll, an area on a circumferential surface of the pinch roller opposing a lower side of the first winding roll, a portion of the circumferential surface of the pinch roller projecting into the channel formed between the core support plate and the first winding roll; and at least one arm having a circular arc portion extending about the first winding roll to a lower side thereof, the arm having a lower outer surface facing toward the pinch roller, the lower outer surface being formed with a protuberance projecting beyond a circumferential surface of the first winding roll by a predetermined distance, a narrowed passage being formed in the channel thereby between the protuberance and the portion of the circumferential surface of the pinch roller projecting into the channel;

whereby a second core sent into the channel via the loading nip and rolled to the narrowed passage is hindered by the narrowed passage while being driven by the circumferential surface of the pinch roller to rotate, the tissue paper being thereby clamped between the second core and the protuberance of the arm, and the tissue paper at a portion extended between the first and the second cores being pulled broken due to continued rolling of the first core in the winding nip while the second core is hindered at the narrowed passage.

2. The tissue paper winding and cutting apparatus as claimed in claim 1, further comprising a conveyor, with which the second core is sent into the channel.

3. The tissue paper winding and cutting apparatus as claimed in claim 2, further comprising a gluing unit arranged at a predetermined position on the conveyor for applying an amount of glue on an outer surface of the second core; such that a leading edge newly formed on the broken tissue paper is adhered to the outer surface of the second core at the channel, bringing the subsequent tissue paper to be wound around the second core.

4. The tissue paper winding and cutting apparatus as claimed in claim 1, further comprising a second winding roll and a rider roll; and wherein the winding nip is located between the first winding roll, the second winding roll, and the rider roll.

5. A tissue paper winding and cutting apparatus, comprising:

a first winding roll;

at least one core support plate arranged in the vicinity of the first winding roll, a channel having a loading nip and a winding nip being formed between the first winding roll and the core support plate, whereby a continuous strip of tissue paper is passed through the loading nip to attach to a lower half circumferential surface of the first winding roll and be wound around a first core in the winding nip;

a pinch roller spaced from the first winding roll, an area on a circumferential surface of the pinch roller opposing a lower side of the first winding roll, a portion of the circumferential surface of the pinch roller projecting into the channel formed between the core support plate and the first winding roll;

at least one arm having a circular arc portion extending about the first winding roll to a lower side thereof, the arm having a lower outer surface facing toward the pinch roller, the lower outer surface being formed with a protuberance projecting beyond a circumferential surface of the first winding roll by a predetermined distance, a narrowed passage being formed in the channel thereby between the protuberances and the portion of the circumferential surface of the pinch roller projecting into the channel; and a glue tank having an amount of glue contained therein and being arranged in the vicinity of the pinch roller to apply a glue layer on the circumferential surface of the pinch roller;

whereby a second core sent into the channel via the loading nip and rolled to the narrowed passage is applied with the glue layer transferred from the pinch roller to an outer surface of the second core; the second core being hindered by the narrowed passage while being driven by the circumferential surface of the pinch roller to rotate, the tissue paper being thereby clamped between the second core and the protuberance of the arm, and the tissue paper at a portion between the first and the second cores being pulled broken due to continued rolling of the first core in the winding nip while the second core is hindered at the narrowed passage; and, the second core thereafter rolling forward with a leading edge newly formed on the broken tissue paper adhered to the outer surface of the second core.

6. The tissue paper winding and cutting apparatus as claimed in claim 5, wherein the glue tank includes a scraper for scrapping off surplus glue to control the amount of glue to be applied on the circumferential surface of the pinch roller.

7. The tissue paper winding and cutting apparatus as claimed in claim 6, further comprising a glue dispensing roll provided between the glue tank and the pinch roller for transferring the glue from the glue tank to the circumferential surface of the pinch roller.

8. The tissue paper winding and cutting apparatus as claimed in claim 5, further comprising a second winding roll and a rider roll; and wherein the winding nip is located between the first winding roll, the second winding roll, and the rider roll.

9. The tissue paper winding and cutting apparatus as claimed in claim 5, further comprising a conveyor, with which the second core is sent into the channel.

* * * * *